United States Patent [19]

Salzman et al.

[11] 4,392,830

[45] Jul. 12, 1983

[54] BODY COORDINATION TRAINING AID

[76] Inventors: Norman Salzman, 10508 Gainsborough Rd., Potomac, Md. 20854; Edward Wellner, 4028 Hunt Rd., Fairfax, Va. 22031

[21] Appl. No.: 315,496

[22] Filed: Oct. 27, 1981

[51] Int. Cl.[3] ..... A63B 69/36

[52] U.S. Cl. ..... 434/258; 273/183 B; 273/190 A

[58] Field of Search ..... 434/247, 249, 250, 252, 434/258; 273/186 B, 185 B, 190 A; 128/731–733

[56] References Cited

U.S. PATENT DOCUMENTS

| | | | |
|---|---|---|---|
| 2,064,603 | 12/1936 | Harrison | 434/252 |
| 3,156,211 | 11/1964 | Mallory | 273/190 A |
| 3,362,023 | 1/1968 | McMahon | 273/183 B |
| 3,508,751 | 4/1970 | Meyer et al. | 273/310 |
| 4,330,123 | 5/1982 | Kleinerman | 273/54 B |

OTHER PUBLICATIONS

John Markus, "*Source Book of Electronic Circuits*"; *1968, p. 46; Velocity Response Phono Preamp.*

*Primary Examiner*—Vance Y. Hum
*Assistant Examiner*—Leo P. Picard
*Attorney, Agent, or Firm*—Harold Gell

[57] ABSTRACT

A body coordination training aid is presented for providing audio signals to a user in response to the user's head and shoulders assuming a predetermined relative orientation. This is accomplished via an electronic circuit responsive to a first electrode contacting a second electrode to complete an electrical circuit.

11 Claims, 14 Drawing Figures

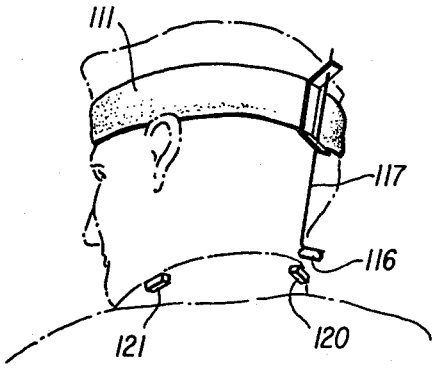
FIG. 9
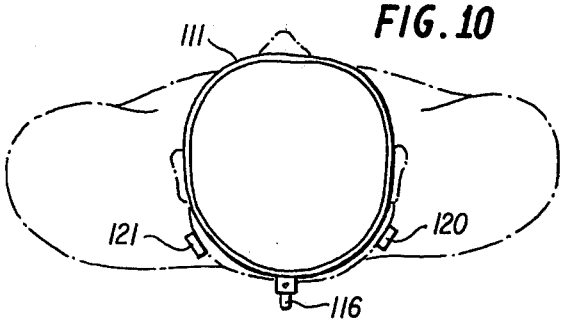
FIG. 10
FIG. 12
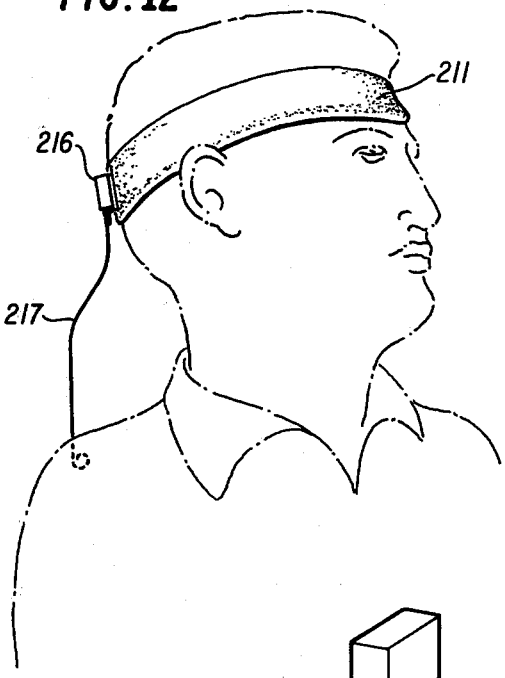
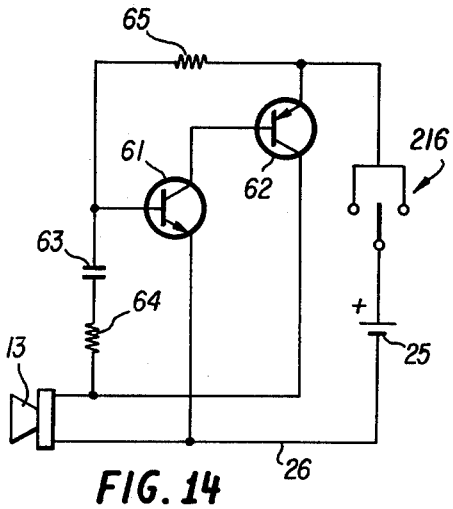
FIG. 14
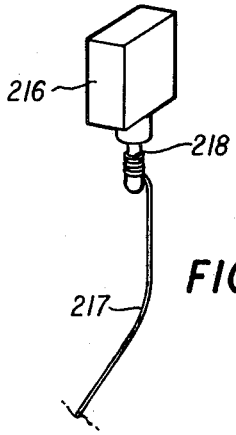
FIG. 13

BODY COORDINATION TRAINING AID

THE INVENTION

This invention relates to a means to provide an audio signal to a user indicative of the user's head and shoulders achieving a predetermined relative orientation.

BACKGROUND OF THE INVENTION

Man has always attempted to improve and perfect the coordination between various body parts such as head and shoulders etc. to perfect the performance of physical tasks required in the accomplishment of work or sports activities. These attempts have resulted in a variety of approaches, many of which are highly successful but requiring supportive services or constraints rendering them non-applicable to all situations.

A classical method of improving a person's coordination has been through the use of an instructor who will observe a trainee's actions. This approach is not always successful or advisable in some situations because the observer or instructor may not be able to ascertain if the precise and exact coordinated effort has been accomplished. This method is fairly costly because an instructor must normally be hired and the expense precludes the person of average monetary resources from obtaining the amount of practice that may be required to perfect his coordination.

Numerous attempts have been made to circumvent the need for an observer so that an individual may engage in self-improvement practice sessions when instructors or observers are not available or it is desired that their services not be employed for numerous personal and financial reasons. Included among the various attempts to eliminate the use of an observer are the use of mirrors and physical restraints.

Practicing a function that requires body coordination before mirrors has been highly successful for certain types of coordination but when the body coordination which is to be improved requires a person's visual contact with an object during the coordinated movements, the use of mirrors is impractical. For instance, if a person is attempting to improve his coordination in swinging a tennis racquet, golf club, baseball bat or similar sports implement which requires the participant to maintain eye contact with an object while attempting to strike it, it is impossible for the trainee to view his actions in a mirror.

The use of physical constraints has numerous disadvantages because the constraints often times hamper the free flowing movement which the trainee is attempting to achieve and therefore the use of a constraint may provide more harmful effects than benefits in various training situations.

OBJECTIVES OF THE INVENTION

In view of the obvious lack of a simple body coordination sensing means which will sense the relative position of body parts without encumbering a trainee with physical constraints, it is a primary objective of the present invention to provide a lightweight device which may be worn by a trainee but which will not hamper body movements and which will provide an audible alarm or signal when predetermined body parts reach a predetermined orientation.

A further objective of the present invention is to provide an audible signal to a golfer indicating when his head and shoulders have achieved a predetermined relative orientation during the execution of a golf swing.

A still further objective of the present invention is to provide a lightweight audio signaling system that may be mounted in a head band or cap so that a low volume audio device may be utilized to signal the wearer.

It is a further objective of the present invention to provide a means where vertical electrodes may be supported on a trainee's shoulder and electrically connected to an audio generator by a means whereby an electrical circuit is completed to activate the audio generator when a second electrode contacts the vertical shoulder mounted electrodes.

A still further objective of the present invention is to provide an audio generator responsive to relative movement of at least two body parts for creating an audio signal transmitted to a trainee via an ear plug transducer system.

The foregoing and other objectives of the invention will become apparent in light of the drawings, specification and claims contained herein.

SUMMARY OF THE INVENTION

Presented hereby is an electronic device to sense the relative position of two body parts and provide an audible indication of the positioning to a trainee. This is accomplished through a DC tone generator mounted in a sweat band or cap and adapted to drive a small speaker or earphone. In one embodiment a sensing wire or electrode is secured to the cap or head band and adjusted so that it will contact additional sensing wires positioned on the trainee's shoulders. The sensing wires positioned on the trainee's shoulders are electrically connected to the tone generator so that an electrical circuit is completed to energize the tone generator when the sensing wires supported by the head band or hat contact a shoulder supported sensing wire. Thus an audible signal is provided to a trainee when the trainee's head and shoulders achieve a predetermined orientation such as is desired during the execution of a golf club swing. A second embodiment is provided wherein the electrical circuit is energized in response to a read switch supported on an arm connected to the user's head via a sweat band or cap. The reed switch is activated as it moves past magnetic devices secured to the trainee's collar or shoulder to create a signal as in the first embodiment when the head and shoulder reach a predetermined relative orientation.

A further embodiment is provided wherein the tone generator is activated by a switch supported by a device affixed to the user's head and including an extended switch actuating arm which causes switch closure when the actuating arm comes in contact with the trainee's shoulder.

DESCRIPTION OF THE DRAWINGS

FIG. 9 illustrates a trainee wearing the coordination alerting system incorporating a reed switch activation means.

FIG. 10 illustrates the placement of magnetic means on the user's collar for the reed switch embodiment.

FIG. 12 illustrates a trainee wearing the coordination alerting system incorporating a mechanical switch as a sensing means.

FIG. 13 illustrates the mechanical sensing means.

FIG. 14 is a schematic diagram of the mechanical switch embodiment.

DESCRIPTION OF THE INVENTION

Figure 1:
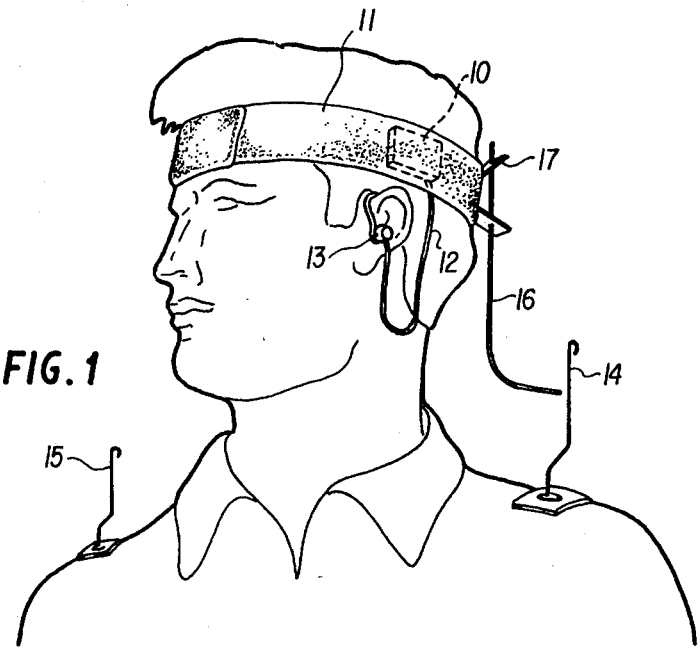
FIG. 1 illustrates a trainee wearing the coordination alerting system.

FIG. 1 illustrates a person wearing an embodiment of the present invention wherein an audio generator 10 is postioned within a terry cloth head band or sweat band 11. A lightweight electrical conductor 12 couples the audio generator 10 to earphone 13 whereby the wearer can receive an audio signal. Shoulder electrodes 14 and 15 are positioned on either shoulder where they may be contacted by the head electrode 16 which is supported from the head band 11 in an adjustable clip 17.

Figure 2:
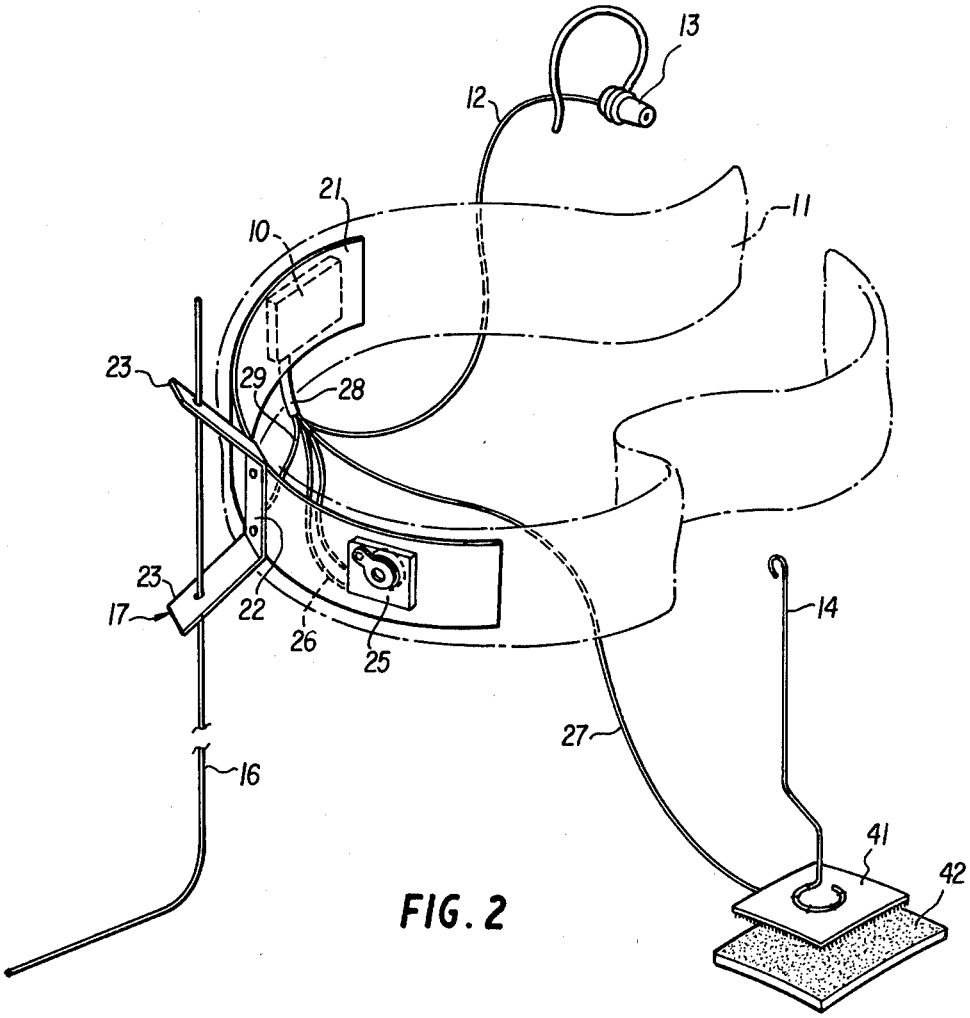
FIG. 2 is a cutaway view of a preferred embodiment of the present invention wherein the electronics and power source are mounted in a head band.

The interconnection and relation of the components illustrated in the embodiment of FIG. 1 may be more clearly seen in the cutaway view of the head band of FIG. 2. Positioned within head band 11 is a flexible mounting strip 21 which in a preferred embodiment is a thin, rigid but flexible non-conducting plastic material of very lightweight. The clamp 17 which supports the head electrode 6 is comprised of a flat spring steel member formed so that it has a flat section 22 having a dimension approximately equal to the width of the mounting strip and two extending arms 23 which each have a hole therethrough positioned such that electrode 16 may pass through both holes when members 23 are flexed toward each other. Since electrode 16 is formed from a thin gauge rigid material such as a spring steel wire, the slightly off center holes in the split arms 23 bind the electrode and hold it securely in any desired position.

The supporting clamp 22 is rivoted to the center of the mounting strip 21 and a wire electrically connects the conductive mounting and electrode 16 to the audio generator 10. The audio generator is connected to a battery 25 by wire 26. A second contact to the battery to complete the circuit is provided by wire 27 which is routed from the shoulder electrodes 14 and 15 via the audio generator wire distribution channel 28.

Figure 5:
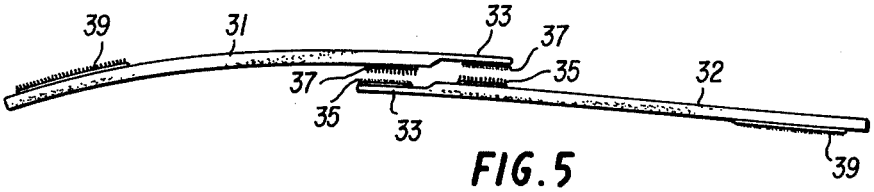
FIG. 5 is a detailed illustration of a sweat band adapted to receive the major electronic components of the present invention.

The head band 11 is a two piece structure which may be seen more clearly in FIG. 5. It is comprised of two identical terry cloth tubular structures 31 and 32. At one end of the tubular structure a flap 33 extends past the opening end structure and supports on the face toward the opening a Velcro pile patch 35. A Velcro loop patch 37 is secured to the tubular structure on the same side as the pile patch 35 and adjacent to the opening at the base of the flap 33. Thus the terry cloth tubular structures 31 and 32 may be slid over opposite ends of mounting strip 21 of FIG. 2 and secured thereabout by the Velcro fasteners with the mounting clamp 17 protruding therefrom as illustrated in FIG. 2. The opposite ends of the tubular structures 31 and 32 of FIG. 5 are provided with elongated Velcro fastening means 39 so that the completed head band 11 may be adjustably secured about a user's head.

Figure 4:
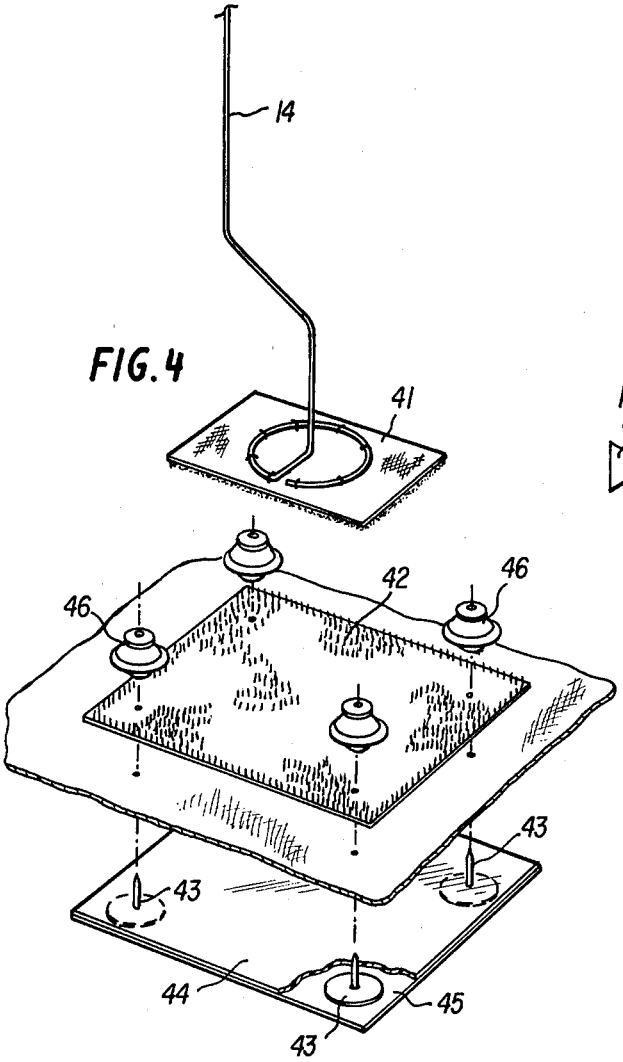
FIG. 4 is a detailed illustration of the means for securing the vertical shoulder supported sensing wires.

The vertical electrodes 14 and 15 of FIG. 1 are secured to a section of Velcro fastening 41 such as is illustrated for electrode 14 in FIGS. 2 and 4. A mating Velcro fastener 42 is secured to a user's shoulder so that the electrodes may easily be removed without electrically disconnecting them from the head band. The Velcro fastener 42 may be sewn to the user's outer garment as illustrated in FIG. 1 or they may be secured thereto temporarily by safety pins or an arrangement such as illustrated in FIG. 4 wherein a plurality of tacks 43 are secured between two sheets of thin plastic or fabric material 44 and 45. This material should be smooth, lightweight and flexible so as not to create an irritation for the user. In a preferred embodiment, the sheets of material have one surface which is adhesive with the adhesive faces toward each other to create a secure laminated structure with the points of the tacks protruding therefrom in a predetermined pattern.

The tack assembly of FIG. 4 is placed on the inside of the outer garment and the tacks forced through the garment. The Velcro fastener is then placed over the tacks so that the tacks protrude from the connection side of the Velcro fastener and clutch back devices 46 are used to secure the resultant assembly to the garment.

Figure 3:
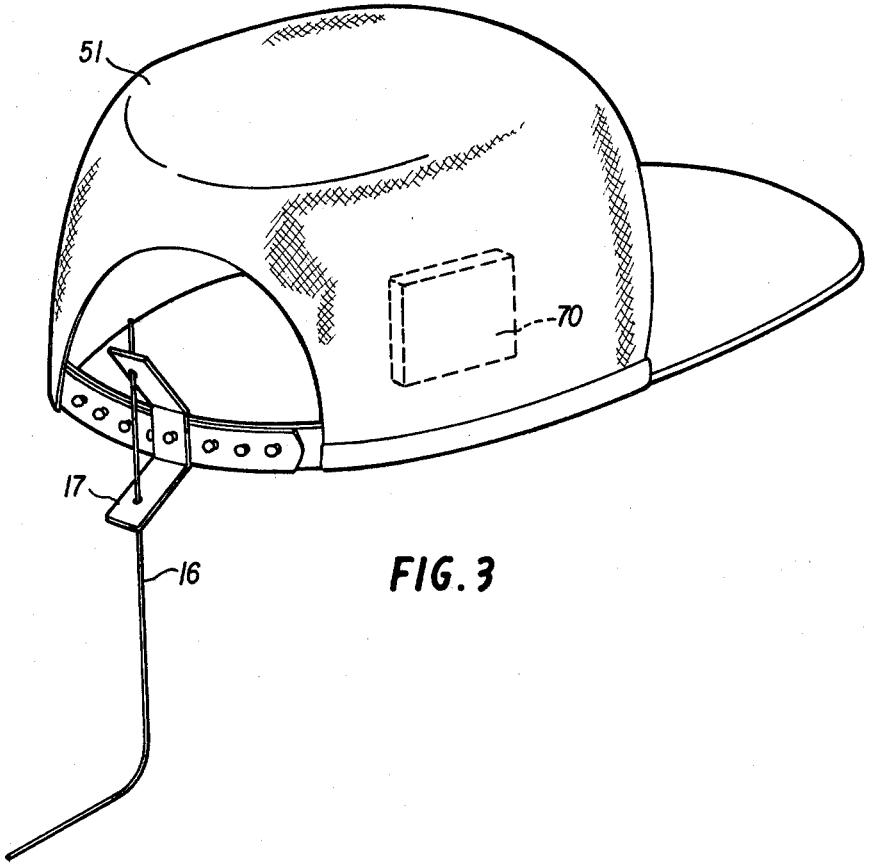
FIG. 3 illustrates an alternate embodiment wherein the major components of the system are incorporated in a cap.

FIG. 3 is an alternate embodiment wherein clamp 17 is secured to the back of a cap 51 and the electronics are secured therein in some convenient area at the discretion of the cap designer.

Figure 6:
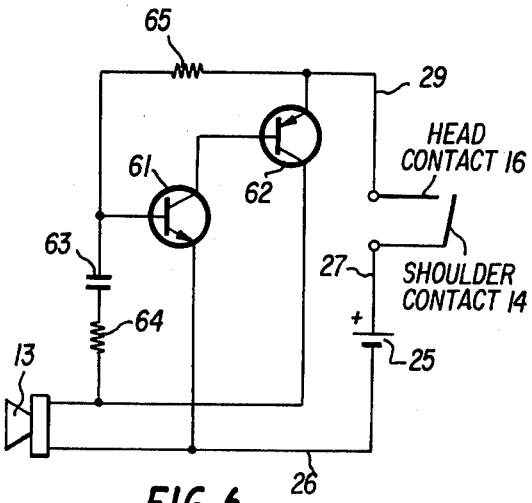
FIG. 6 is a schematic diagram of the electronics utilized by the present invention.

FIG. 6 is a schematic diagram of one type of audio generator that may be used in the present invention. In this embodiment, bipolar transistors 61 and 62 form an oscillator having a tank circuit including capacitor 63 and resistor 64 which is calculated to provide an oscillation having an audio frequency that is pleasing but yet alerting to the user. Resistor 65 and the impedance of earphone 13 complete the oscillator circuit.

The transistors, resistors, and capacitor are located on a common mounting board which is electrically coupled to earphone 13 by cable 12, battery 25 via wire 26 and head contact electrode 16 via wire 29. Shoulder contact 14 is electrically coupled to the other pole of battery 25 via wire 27 so that the oscillator will be energized whenever head contact 16 contacts shoulder contact 14.

Figure 7:
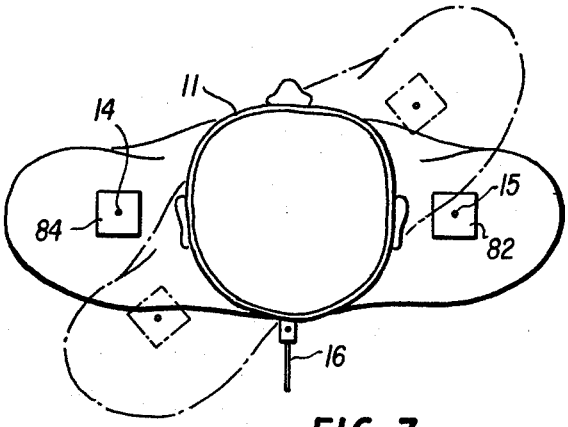
FIGS. 7 and 8 illustrate the operation of the invention with respect to relative body movements of a trainee.
Figure 8:
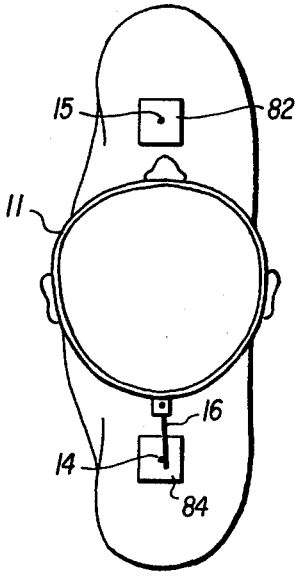

FIGS. 7 and 8 illustrate the relative head and shoulder movements of a golfer during interim portions of a golf swing. In FIG. 7 note that electrode 16 does not contact electrode 14. This is an interim positioning of the head and shoulders. In FIG. 8, the desired head/-shoulder orientation has been achieved and electrode 16 contacts electrode 14, completing the power circuit to the oscillator and causing an audio tone to be generated in the earphone. The position illustrated in FIG. 8 illustrates the proper head and shoulder relationship that a tennis player should achieve in anticipation of the start of a forehand or backhand stroke.

In the alternate embodiment illustrated in FIG. 3, the oscillator may include a miniature speaker in lieu of the earphone. The oscillator/speaker assembly 70 may then be secured to the side of a hat 51 near the user's ear so that the audio signal may easily be heard.

A still further adaptation of the present invention is illustrated in FIG. 7 wherein the battery and oscillator are combined in a single unit 84 which is part of the mounting for shoulder electrode 14. In this way, the associated head band or hat need only provide a means to support head electrode 16 with an earphone being provided or a miniature speaker associated with the mounting for shoulder electrode 14 or 15.

FIG. 8 illustrates an embodiment similar to the embodiment of FIG. 7 wherein the electronic oscillator 84 is contained within the mounting for shoulder electrode 14 and the battery and loud speaker combination 82 are assembled in the mounting for shoulder electrode 15.

Figure 11:
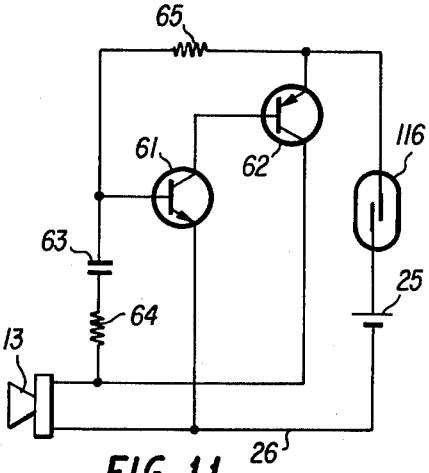
FIG. 11 is a schematic diagram of the reed switch embodiment.

FIG. 11 is a schematic of an alternate embodiment of the subject invention. This schematic illustrates circuitry identical to that illustrated in FIG. 6 with the exception of the activating switch. In the embodiment of FIG. 11, a reed switch 116 replaces the head and shoulder contacts of FIG. 6 while the remainder of the electronics remains the same as is indicated by the use of identical reference designators in both FIGS. 6 and 11.

FIG. 9 illustrates the reed switch embodiment wherein the reed switch 116 is suspended from a rod 117 affixed to a sweat band 111. Support rod 117 is secured to the sweat band in the same fashion as contact 16 of the embodiment of FIG. 1. If desired, support rod 117 may be suspended from the rear of a cap as illustrated in FIG. 3 for contact 16. The reed switch embodiment normally uses two magnets 120 and 121 which may be secured to the user's shoulders in the same fashion as contacts 14 and 15 of FIG. 1 or in a preferred adaptation of this embodiment, they may be affixed to the user's collar such as illustrated in FIGS. 9 and 10. Thus as the user's head is rotated in relationship to his shoulders, reed switch 116 passes over either magnet 120 or 121, see for instance FIG. 10, and the audio alert means is energized.

FIG. 14 is a schematic diagram of a still further embodiment of the subject invention wherein the head and shoulder contacts 16, 14 and 15 of FIGS. 1 and 6 are replaced by a single-pole double-throw switch 216 which is spring biased to the off position. The schematic of FIG. 14 is identical with the schematic of FIGS. 6 and 11 with the exception of the activating switching means and similar reference designators between the three schematics indicate similar electronic components.

The double-throw single-pole switch 216 of FIG. 14 is graphically illustrated in FIG. 13 which depicts the extension rod 217 which is secured to the activating lever 218 of a standard spring biased toggle switch 216. The application of extension 217 may be more readily seen in FIG. 12 wherein switch 216 is secured to the back of a user's head by being fastened to a sweat band 211 or cap. Extension 217 is long enough to descend below the user's shoulders and incorporate a curved segment which causes the lower end to extend away from the back so that it will not be engaged by the user's back during normal maneuvers. However, in manipulating a tennis racket or other sporting apparatus, as the user's head turns with relation to his shoulders, the extension 217 will engage the shoulder and cause toggle switch 216 to close. This has the same result as closing of the reed switch in the reed switch embodiment or contacting head contact 16 with either shoulder contact 14 or 15 in the first embodiment of the subject invention.

In a preferred embodiment of the mechanical switch embodiment of FIGS. 12 thru 14, rod 217 is fabricated from a material which will permit forming the rod to clear the user's back as illustrated in FIG. 12.

While preferred embodiments of this invention have been illustrated and described, variations and modifications may be apparent to those skilled in the art. Therefore, I do not wish to be limited thereto and ask that the scope and breadth of this invention be determined from the claims which follow rather than the above description.

What I claim is:

1. A body coordination training aid, comprising:
- an audio oscillator;
- a power source for said audio oscillator;
- a first electrode;
- a second electrode;
- said first and second electrodes configured to make electrical contact when said user's head and shoulder are in a predetermined relative orientation;
- means to electrically contact said audio oscillator to said power source via said first and second electrodes;
- a mounting means for adjustably holding said first electrode and adapted to be mounted to the user's head; and
- a rigid, flexible, non-conducting mounting strip for supporting said mounting means, said audio oscillator, and said power source.

2. A body coordination training aid, as defined in claim 1, wherein said first electrode is supported by the user's head and said second electrode is supported by the user's shoulder.

3. A body coordination training aid, as defined in claim 2 wherein the adjustable mounting means is a spring steel clip and a two piece sweat band configured to form a packet for containing said mounting strip such that said mounting means is exposed and said audio oscillator and said power source are concealed.

4. A body coordination training aid as defined in claim 3, further including an earphone electrically connected to said audio oscillator.

5. A body coordination training aid as defined in claim 2, comprising:
- a laminated structure including a plurality of tacks having points protruding from a common side thereof;
- a garment, said laminated structure positioned so that said tacks protrude from said garment;
- one half of a Velcro fastening couple positioned so that said tacks protruding through said garment protrude through said Velcro fastening couple;
- a clutch back device for each of said tacks for securing said one half of said Velcro fastening couple to said garment; and
- a Velcro fastening couple of the type adapted to mate with said one half Velcro fastening couple secured to said second electrode for supporting said second electrode.

6. A body coordination training aid as defined in claim 5, comprising two second electrodes and related supporting structure adapted for mounting on individual shoulders.

7. A body coordination training aid as defined in claim 5, further comprising a miniature loud speaker electrically coupled to said audio oscillator and driven thereby and supported by said Velcro fastening couple supporting said second electrode.

8. A body coordination training aid as defined in claim 3, further comprising a miniature loud speaker supported by said mounting strip and positioned thereon to be adjacent to one ear of said user.

9. A body coordination training aid as defined in claim 2, further comprising:

a cap; and means secured to said cap for supporting said first electrode.

10. A body coordination training aid as defined in claim 9, further comprising:

means within said cap for holding said audio oscillator and said power source.

11. A body coordination training aid as defined in claim 1, wherein said power supply is a battery and said audio oscillator comprises:

an NPN transistor;

a PNP transistor;

an audio transducer electrically connected between the emitter of said NPN transistor and collector of said PNP transistor;

a first resistor;

a capacitor electrically connected in series circuit with said first resistor between the base of said NPN transistor and collector of said PNP transistor;

a second resistor connected between the base of said NPN transistor and the emitter of said PNP transistor;

means to electrically connect the negative pole of said battery to the emitter of said NPN transistor;

means to electrically connect the positive terminal of said battery to said second electrode; and means to electrically connect said first electrode to the emitter of said PNP transistor.

* * * * *